United States Patent [19]

Lefebvre

[11] 4,276,668

[45] Jul. 7, 1981

[54] DEVICE FOR HOLDING IN POSITION THE FORWARD PORTION OF AN INFLATABLE BOAT

[75] Inventor: Jean-Pierre Lefebvre, Joinville-le-Pont, France

[73] Assignee: Creusot-Loire, Paris, France

[21] Appl. No.: 87,969

[22] Filed: Oct. 25, 1979

[30] Foreign Application Priority Data

Oct. 30, 1978 [FR] France ..... 78 30737

[51] Int. Cl.[3] ..... B63B 7/08

[52] U.S. Cl. ..... 9/2 A; 9/11 A; 267/154

[58] Field of Search ..... 9/2 A, 9 A; 267/57, 267/154

[56] References Cited

U.S. PATENT DOCUMENTS 3,163,409 12/1964 Running et al. ..... 267/57 X
3,419,926 1/1969 Magin ..... 9/2 A
3,739,410 6/1973 Fortin ..... 9/2 A

FOREIGN PATENT DOCUMENTS 1571510 6/1969 France ..... 9/2 A
2294907 12/1974 France ..... 9/11 A

*Primary Examiner*—Joseph J. Rolla
*Attorney, Agent, or Firm*—Haseltine and Lake

[57] ABSTRACT

The device includes a rigid stay-bar which is bent so as to reproduce approximately the shape of the forward part of the boat, at least one of the ends of which is connected to a torsion-bar fixed onto the grating and arranged transversely with respect to the boat. The bent central portion of the stay-bar rests against a rigid bearing surface integral with the forward portion of the boat. The stay-bar ensures the holding in position of the forward portion of the boat due to the elastic force exerted by the torsion-bar, which opposes the forces exerted by the waves to lift the forward portion of the boat.

3 Claims, 4 Drawing Figures

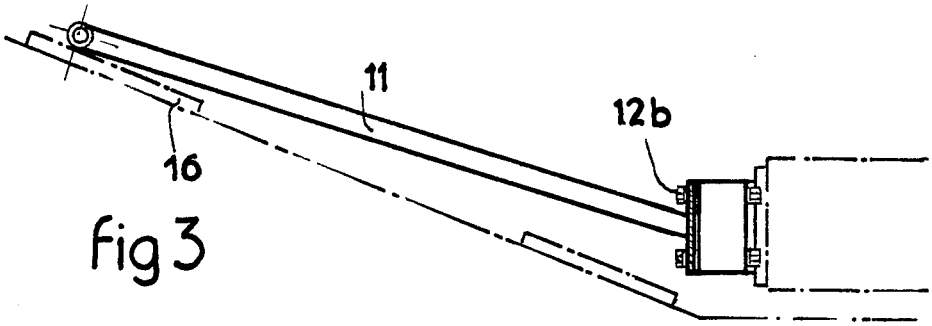
Fig 3
Fig 2
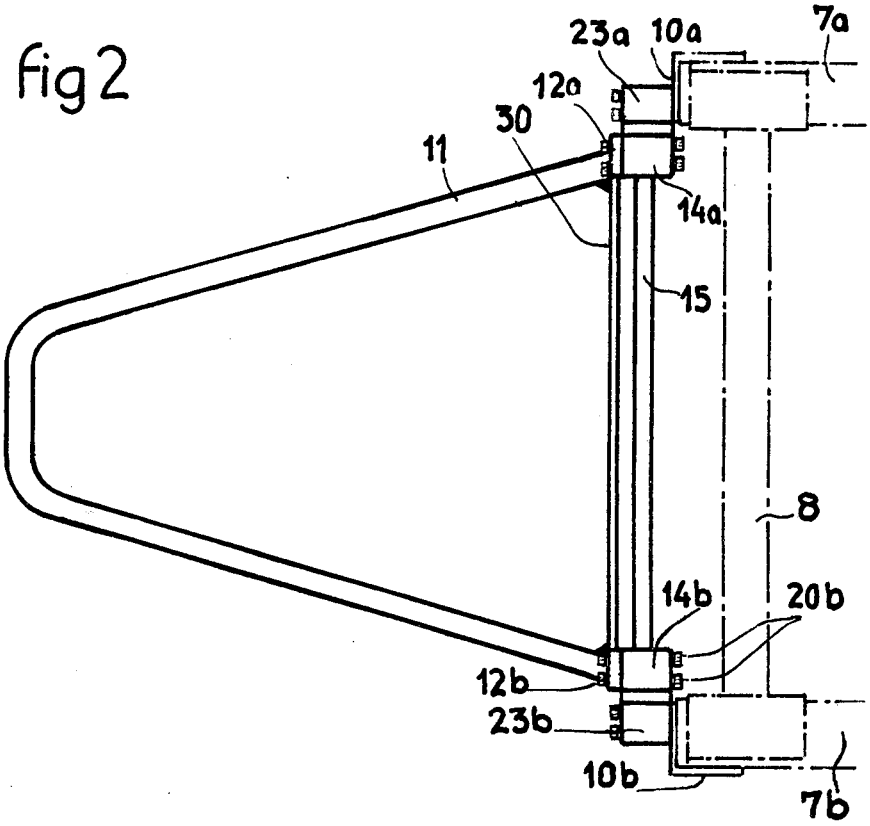

DEVICE FOR HOLDING IN POSITION THE FORWARD PORTION OF AN INFLATABLE BOAT

BACKGROUND OF THE INVENTION

The invention refers to a device for holding in position the forward portion of an inflatable boat in order to avoid excessive deformation of this streamlined forward portion or bow through bending under the force of the waves.

In the case of an inflatable boat including in known manner a tubular float forming the periphery of the boat and defining the forward portion or bow of streamlined shape as well as a bottom consisting of a grating of rigid material and of a sheathing of flexible and impermeable material, the behavior at sea offers advantageous aspects as regards stability but likewise disadvantageous aspects because the boat deforms under the force of the waves, which have the effect of modifying the resistance to progress of the boat. In particular the streamlined forward portion of the boat, which is not held in position by a rigid skeleton, may be caused to deform by bending, the bow of the boat rising with respect to the rest of the boat with the result that the resistance to progress of this inflatable boat is severely increased.

Thus through heavy weather a large portion of the possibilities of the boat may be lost as far as its speed is concerned.

Losses in speed have been observed, for example, of up to 80% between a movement carried out in calm weather and a movement carried out in heavy weather.

In order to correct this disadvantage it is not conceivable to make the bottom of the boat entirely rigid from the forward portion to the rear portion, because the inflatable boat would lose a great deal from it in stability and in the possibility of resistance to capsizing.

SUMMARY OF THE INVENTION

Hence the aim of the invention is to provide a device for holding in position the forward portion of an inflatable boat in order to avoid excessive deformation of this streamlined forward portion or bow through bending under the force of the waves, the boat including in known manner a float forming the periphery of the boat and defining a bow of streamlined shape and a bottom consisting of a grating of rigid material and of a sheathing of flexible and impermeable material located at the bottom portion of the boat. This device prevents excessive losses in speed through bad weather whilst preserving the possibilities of the boat as far as stability and resistance to capsizing are concerned.

With this object the holding device includes a rigid stay-bar which is bent so as to reproduce approximately the shape of the bow of the boat and at least one of the ends of which is connected to a torsion-bar fixed onto the grating and arranged transversely with respect to the boat, and the central bent portion of the stay-bar rests against a rigid bearing surface integral with the forward portion of the boat for holding in position this forward portion by an elastic force exerted by the torsion-bar which opposes the lifting forces exerted by the waves upon the bow of the boat.

DETAILED DESCRIPTION OF THE INVENTION

In order for the invention to be thoroughly understood there will now be described by way of a non-restrictive example an embodiment of the holding device in accordance with the invention.

DESCRIPTION OF THE DRAWINGS

FIG. 2 represents in plan a holding device in accordance with the invention, associated with the forward portion of an inflatable boat such as that represented in FIG. 1.

FIG. 3 represents the same holding device for, in place in an inflatable boat, seen in elevation.

Figure 1:
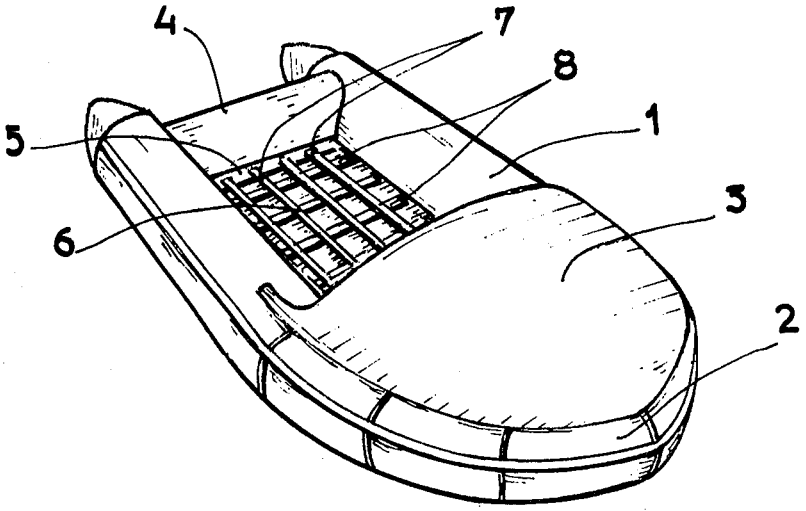
FIG. 1 represents a perspective of an inflatable boat of known type not equipped with a device for holding its forward portion in position.

The inflatable boat represented in FIG. 1 includes a tubular float 1 forming the periphery of the boat at the two sides of the boat and round its streamlined forward portion 2 forming the bow of the boat and covered with a deck 3. The tubular float consists of a flexible and impermeable material such as a rubberized fabric and becomes filled with air at a pressure sufficient to maintain the rigidity of the float.

The deck 3 consists likewise of a flexible and impermeable fabric of the same type as the fabric forming the float.

The rear of the boat consists of a rigid stern panel 4 fixed onto the float at each of its ends.

The bottom 5 of the boat consists of a grating 6 including stringers 7 and crossbars 8. The stringers are not extended to the level of the bow of the boat, with the result that the rigidity of the bottom of the boat is not ensured by the grating from the rear up to the forward part of this boat.

In order to produce the watertightness of the bottom of the boat, the grating is sheathed by an impermeable fabric of the same type as that forming the float and the deck, arranged at the bottom portion of the boat and glued onto the float.

Referring to FIG. 2, the forward portion of the grating is shown formed by two stringers 7*a* and 7*b* and a crossbar 8 maintaining the spacing of the stringers. Corner-plates 10*a* and 10*b* are welded onto the stringers 7*a* and 7*b* for the attachment to the grating of the device.

This holding device includes a stay-bar 11 bent in a stirrup shape in order to reproduce approximately the shape of the bow of the boat against which the bar comes to bear. This stay-bar consists of a metal tube which is bent and welded at each end of it to fixing plates 12*a* and 12*b*.

The plates 12*a* and 12*b* are in turn fixed onto bearings 14*a* and 14*b* the construction of which will be described in greater detail when referring to FIG. 4.

Figure 4:
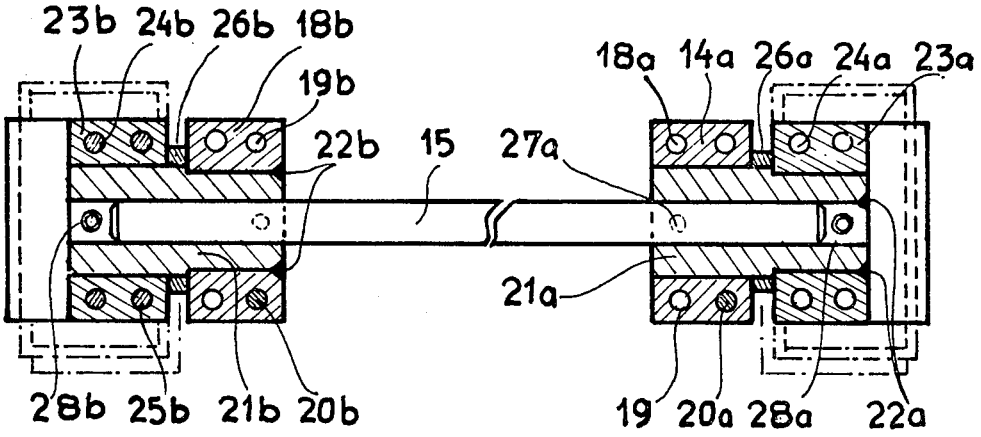
FIG. 4 represents a section through the device at the level of the torsion-bar and its trunnions for attachment to the grating in the inflatable boat.

The device likewise includes a torsion-bar 15 fixed with respect to the grating due to bearings represented in FIG. 4.

The front portion of the stay-bar comes to rest against a rigid bearing plate 16 fixed onto the bottom of the boat at the tip of the bow.

Referring to FIG. 4, it is seen that the bearing 14*a* consists of a movable portion 18*a* including four fixing holes such as 19 for passing through fixing bolts 20*a* which connect the end plate 12*a* integral with the stay-bar, to this movable portion 18*a* of the bearing.

The movable portion 18*a* of the bearing turns about a central pin 21*a* which in turn is fixed by a circular weld 22*a* onto a fixed bearing 23*a* equipped with four fixing holes such as 24 enabling bolts 25*a* to be passed through, enabling the fixed bearing 23*a* to be made integral with the corner-plate 10*a* and the stringer 7*a*.

A ring 26*a* enables the spacing to be maintained between the movable portion 18*a* of the bearing 14*a* and the fixed portion 23*a*.

The fixed pin 21*a* includes in its central portion an aperture 27*a* of square section which passes through it from side to side and enables the introduction and the fixing in rotation of the torsion-bar 15 of square section of corresponding dimensions, the position of which in the aperture arranged in the pin 21*a* is maintained by cotters such as 28*a*.

In this way the torsion-bar 15 is integral with the grating of the boat by way of the part 21*a*, the support 23*a*, the corner-plate 10*a* and the stringer 7*a*. The end of the stay-bar is for its part capable of turning about the pin 21*a* due to the bearing 18*a*.

At the other end of the torsion-bar arranged transversely with respect to the boat, the second end of the stay-bar is connected by a device including holes 19*b* and bolts 20*b* to a part 18*b* to which is fixed by a weld 22*b* a pin 21*b* which turns in a fixed bearing 23*b* which by way of holes 24*b* and bolts 25*b* is made integral with the corner-plate 10*b* and the stringer 7*b*.

The spacing between the parts 18*b* and 23*b* is maintained by a sliding ring 26*b* which enables relative movement in rotation between these two parts.

The part 21*b* includes an aperture of square section in its central portion which enables the introduction and the fixing in rotation in this part, of the end of the torsion-bar which is kept in place by cotters 28*b*.

In this way the stay-bar which is integral in rotation with the torsion-bar turns inside a fixed part connected to the grating of the boat.

This torsion-bar mounting known in other devices enables the assembly of fixed and moving bearings to be produced with similar parts at each end of the torsion-bar, which enables easy replacement of the parts and a reduction in the number of mechanical components necessary for producing the assembly.

In order to maintain the spacing between the two bearings which bring about the fixing of the stay-bar with respect to the torsion-bar, with the possibility of rotation, a rigid strut 30 has been arranged between these bearings in a direction transverse to the boat.

The operation of the device is as follows: the arrangement and the slope of the stay-bar are designed so that when the boat is not being deformed, the end of the stay-bar comes to rest against the bearing-plate 16, the torsion-bar not being subjected to any force.

When the boat is at sea and is undergoing the action of the waves against its forward portion, the forces are transmitted by way of the bottom of the boat and the bearing part 16 to the stay-bar which has the tendency to be raised and to turn about the axis of the torsion-bar. Since the stay-bar is integral with this torsion-bar at one end of it by way of the parts 18*b* and 21*b*, this rotation of the stay-bar brings about a torsion of the bar 15 which is integral with the grating by way of the parts 21*a* and 23*a*. The torsion-bar 15 then has a tendency to bring the stay-bar back into its starting position, cancelling the bending of the forward portion of the boat by elastic force. The strength of this elastic force is calculated so that the return of the bow of the boat into its undeformed position is effected under good conditions whilst avoiding having too rigid a boat.

In this way at the time when the boat is being lifted the bow undergoes a certain bending and the torsion-bar accumulates a certain energy of deformation which it restores while cancelling the bending of the bow of the boat at the time when this boat rises above the wave again. In this way the boat has an increased facility for surmounting the waves and its speed is only a little reduced by heavy weather with respect to the speed in calm weather.

Instead of a reduction in speed of 80% observed in the case of inflatable boats not equipped with a holding device, in the case of heavy weather a loss in speed has been observed of only 20% with respect to the speed in calm weather.

The boat instead of being braked and of having a tendency to plunge into the water, can raise itself above the waves and thus free itself of a considerable restraining force.

But the invention is not restricted to the embodiment which has just been described, it includes on the contrary any variant. Thus the stay-bar has been fixed onto the end bearings at an angle of 75° with respect to the vertical, but it is possible to employ any angle whatsoever as a function of the shape of the bottom of the boat and the foreseen height of the waves.

A method of attachment of the torsion-bar onto the grating has been described, which enables the employment of mechanical parts few in number, but it is possible to conceive of another method of attachment of the torsion-bar.

Finally, the holding device in accordance with the invention is applicable to any type of inflatable boat which it is desired to employ over water surfaces in a state of agitation, in particular at sea.

I claim:

1. In combination with an inflatable boat including a tubular float forming the periphery of the boat and defining a bow of streamlined shape and a bottom consisting of a grating of rigid material and of a sheathing of flexible and impermeable material located at the bottom portion of the boat, a device for holding in position the forward portion of the boat to avoid excessive deformation of the bow under the force of the waves, said device comprising a torsion-bar fixed onto the grating and arranged transversely with respect to the boat, a rigid stay-bar bent so as to reproduce the shape of the bow and having at least one of its ends connected to said torsion-bar, a rigid bearing surface integral with the forward portion of the boat and supporting the central bent portion of the stay-bar for holding in position this forward portion by an elastic force exerted by the torsion-bar, which opposes the lifting forces exerted by the waves upon the bow of the boat.

2. The device as in claim 1 further comprising a pair of plates one fixed at each end of the torsion-bar and wherein the stay-bar consists of a metal tube bent into the shape of a stirrup and connected by welding at each end to one of said plates.

3. The device as in claim 1 or 2 further comprising a first pin integral with said grating and inside which one end of said torsion-bar is locked in rotation, a first part movable in rotation about said first pin and connected to one end of said stay-bar, a rotatable second pin integral with the other end of the stay-bar, the other end of said torsion-bar being locked in rotation inside said second pin, and a second part integral with said grating and inside which said second pin is rotatable.

* * * * *